United States Patent [19]

Goldbeck et al.

[11] Patent Number: 4,665,843

[45] Date of Patent: May 19, 1987

[54] SEWING DEVICE FOR PRODUCING PIPED OPENINGS IN SEWING MATERIAL

[75] Inventors: Heinz Goldbeck, Bielefeld; Horst Plassmeier, Herford; Herbert Struck, Löhne, all of Fed. Rep. of Germany

[73] Assignee: Durkoppwerke GmbH, Fed. Rep. of Germany

[21] Appl. No.: 849,725

[22] Filed: Apr. 9, 1986

[30] Foreign Application Priority Data

Apr. 10, 1985 [DE] Fed. Rep. of Germany ..... 3512772

[51] Int. Cl.[4] ..... D05B 3/10

[52] U.S. Cl. ..... 112/68; 112/70

[58] Field of Search ..... 112/68, 70, 65, 67, 112/130, 129, 121.12, 121.11, 264.1

[56] References Cited

U.S. PATENT DOCUMENTS 4,341,169 7/1982 Mainot et al. ..... 112/68 X
4,589,358 5/1986 Goldbeck et al. ..... 112/70 X

FOREIGN PATENT DOCUMENTS 55075 6/1982 European Pat. Off. .
2240617 2/1974 Fed. Rep. of Germany .
3404758 8/1985 Fed. Rep. of Germany .

*Primary Examiner*—Peter Nerbun

*Attorney, Agent, or Firm*—Ostrolenk, Faber, Gerb & Soffen

[57] ABSTRACT

A sewing device for producing piped openings such as pocket slashes, with or without a pocket flap. The sewing device includes a two-needle sewing machine having a vertically moveable center knife for cutting an opening to be piped, a cutting device including two vertically moveable angle cutting knives for performing gusset cuts, and a material transport device for receiving material to be sewn and transporting such material between the sewing machine and the cutting device. Also provided is a control system including a microprocessor for adjusting the operating positions of the various components to move the points of commencement of the parallel seams, the center knife, and the angle cutting knives, individually or jointly, forward or backward, to conveniently and selectively change these sewing parameters in response to the specific workpiece. In one embodiment, a common drive motor is provided for the two-needle sewing machine, the transport device, and the cutting device. Alternatively, the mechanism is substantially simplified in a sewing device wherein the two-needle sewing machine is driven by a first electric motor, and the transport device and the cutting device are driven by at least one additional electric motor.

17 Claims, 9 Drawing Figures

SEWING DEVICE FOR PRODUCING PIPED OPENINGS IN SEWING MATERIAL

BACKGROUND OF THE INVENTION

1. Field of the Invention

The invention relates to a sewing device, and more particularly to a sewing device for producing piped openings such as pocket slashes, with or without a pocket flap.

2. Description of Related Art

A sewing device for producing piped openings is disclosed in Federal Republic of Germany No. OS 22 40 617. This device includes horizontally displaceable cutting blocks having angle cutting knives which are movable vertically upward by pressing means to produce gusset cuts. These cutting blocks are mounted for lateral displacement on parallel guide rails which are fixed on a frame. Each cutting block has an adjustable stop which acts as adjustment means. This sewing device, furthermore, has two driving blocks, also horizontally movable, each of which has a driver for moving intermittently against said adjustable stop.

Also known to the art are devices for folding the piping strip, and sewing material transport devices for transporting material between a delivery point, a sewing point, and a cutting point.

By using such devices, precise agreement between the spacing of the angle cutting knives and the length of the flap, in a piped pocket slash having such a flap, is made possible.

However, in actual sewing, tolerances occur in situations such as when the material being sewn has relatively little stability of shape. These tolerances are frequently compensated for by changing the preestablished values which constitute the basic position of the automatic pocket-slash sewing machine; for instance, the points of initial insertion of the angle cutting knives, and possibly the points of the start and/or the end of the seam, according to empirically determined correction values. These readjustments, which are made, for instance, by shifting the aforementioned stops against the cutting blocks, must be manually performed by specially trained persons, and frequently in places with poor accessibility. Another disadvantage of the prior sewing devices is that no guidance aids are associated with the adjustment means for directly and precisely reading the amount of the shift.

Accordingly, a principal object of the invention is to create a sewing device in which changes may be made very simply in the pre-established values which correspond to the basic position of the automatic pocket-slash sewing machine, for changing the points of insertion of the angle cutting knives as well as the center knife, as well as the points of commencement of both seams, by inputting length-related correction values into a control unit which is provided conveniently within the reach of the operator and within his or her field of view.

With the sewing dèvice of the invention it is now possible, starting from the basic operating position of the automatic pocket-slash sewing machine, to move the points of attack of the parallel seams, the center knive, and the angle cutting knives, individually or jointly, forward or backward over a defined path.

A further object is to provide a simplified mechanical arrangement for the device. The sewing device described above is a very suitable embodiment, in which a common drive is provided for the two-needle sewing machine, the sewing-material transport device, and the cutting device. In an alternate preferred embodiment of the invention, the two-needle sewing machine is driven by a first electric motor, and the sewing-material transport device and the cutting device are driven by at least one additional electric motor, which simplifies the mechanism substantially.

According to preferred aspects of the invention, a sewing device for producing piped openings in sewing material comprises motor means; a two-needle sewing machine having a vertically moveable center knife for cutting an opening to be piped; a cutting device including two vertically moveable angled cutting knives for performing gusset cuts; and a material transport device for receiving material to be sewn and transporting it between the sewing machine and the cutting device. The cutting device, the transport device, and the sewing machine are driven by the motor means. Also provided are control means for controlling the above elements to obtain selected interrelated movements thereof. The control means comprises at least one signal generator for generating movement signals that represent movements of the cutting device and the transport device; and a control unit including input means, a microprocessor and a ROM. The ROM stores data that represent a plurality of predetermined movements that may be performed by the various controlled elements; the input means are for receiving input data indicative of the selected movements to be performed; and the microprocessor is for controlling all the controlled elements to produce piped openings in the sewing material.

Advantageously, the input means comprises a plurality of switches. The switches are for selecting aspects of seams to be sewn by the needles, cutting to be performed by the center knive and gusset cuts to be made by the cutting device. Such data include the length of the seams and the cuts and the locations of the gusset cuts.

In one advantageous embodiment, the transport device and the cutting device are interconnected by gearing means for being commonly driven. The above-mentioned signal generator may be coupled to the gearing means for sensing movement thereof to thereby sense movement of the cutting device and the transport device. The motor means may advantageously comprise one motor which is coupled to the gearing means of the cutting device and the transport device, and also coupled to the sewing machine, for commonly driving the same. Alternatively, the motor means may comprise a first motor drivingly coupled to the sewing machine, and a second motor drivingly coupled to at least one of the cutting device and the transport device. These motors are preferably DC motors or stepping motors.

BRIEF DESCRIPTION OF THE DRAWINGS

Other objects, features, and advantages of the invention will be understood from the following description of preferred embodiments thereof, with reference to the accompanying drawings, in which.

DETAILED DESCRIPTION OF PREFERRED EMBODIMENTS

Figure 1:
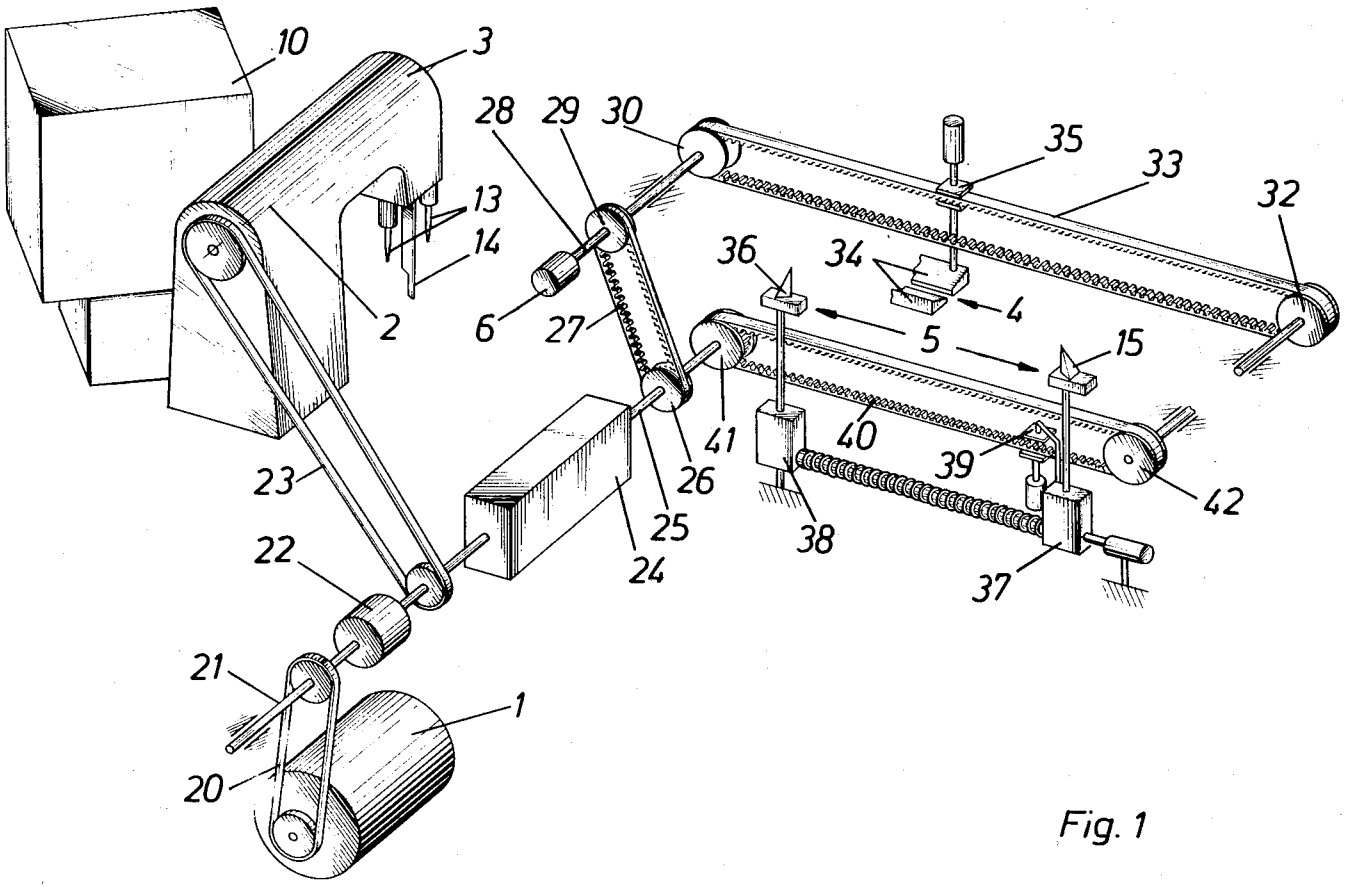
FIG. 1 is a partially exploded perspective view of a preferred embodiment of a sewing device according to the invention.

The sewing device of the invention may be incorporated in an automatic pocket-slash sewing machine such as that described in Federal Republic of German No. OS 22 40 617, the disclosures of which are incorporated herein by reference. Referring to FIG. 1, a sewing device includes a two-needle sewing machine 3, having a vertically cutting center knife 14 provided between the sewing needles 13, which produces a slit 19 parallel to a seam or seams for a pocket-slash opening. The two-needle sewing machine 3 is fastened to an upper tabletop on a frame, not shown in FIG. 1, and is driven by an electric motor 1 which is arranged below the tabletop. A needle positioning drive includes a drive shaft 21, mounted below the tabletop and within the frame, and driven by the motor 1 via a V-belt 20. From this drive shaft, a main shaft 2 of the two-needle sewing machine 3 is driven via a clutch 22 and another V-belt 23.

The drive shaft 21 extends further to a step-down gearing 24. A toothed-belt pulley 26 is rigidly connected to the output shaft 25 of the step-down gearing 24. A toothed belt 27 drives a shaft 28 which is mounted in fixed position on the frame and is arranged above the tabletop. Toothed-belt pulleys 29 and 30 are firmly mounted on the shaft 28. An incremental rotation sensor 6 is also firmly mounted on the shaft 28. The sensor 6 generates pulses which can be read by a control unit 10 mounted on the tabletop, the pulses corresponding to the lateral displacement movement of a horizontally movable sewing-material transport device 4 and the horizontal path of displacement of a movable angle cutting knive 15. The cutting knife 15 is part of a cutting device 5, for the production of the two gusset cuts 31 (see FIG. 6) of the pocket-slash opening.

Another toothed-belt pulley 32 is rotatably secured to the frame above the tabletop. A toothed belt 33 wraps around the toothed-belt pulleys 30, 32. The sewing-material transport device 4 includes two sewing-material clips 34 to which a pneumatically or electromagnetically actuatable clamp 35 is firmly connected. Upon pneumatic or electromagnetic actuation, the clamp 35 is closed on the belt 33 to effect the horizontal displacement of the sewing-material transport device 4.

A suitable cutting device 5 is known from Federal Republic of Germany No. OS 34 04 758, which corresponds to U.S. patent application Ser. No. 699,027, filed Feb. 7, 1985, now U.S. Pat. No. 4,589,358, the disclosures of which are incorporated herein by reference. It includes two angle cutting knives 15, 36 which are arranged below the tabletop and are intermittently movable upward in a vertical direction. The angle cutting knive 36 is mounted in a stationary cutting block 38 while the angle cutting knife 15 is received by a cutting block 37 which is displaceable in a horizontal direction. The displacement of the cutting block 37, which is in a direction opposite to the displacement of the sewing-material transport device 4, is produced by means of a clamp 39 which can be actuated pneumatically or electromagnetically and is firmly attached to the cutting block 37. Upon such actuation, the toothed belt 40 is clamped between the two clamping jaws of the clamp 39. As shown in FIG. 1, the toothed belt 40 wraps around a toothed-belt pulley 41 which is secured to the output shaft 25, and another toothed-belt pulley 42 which is rotatably mounted on the frame below the tabletop.

Figure 5:
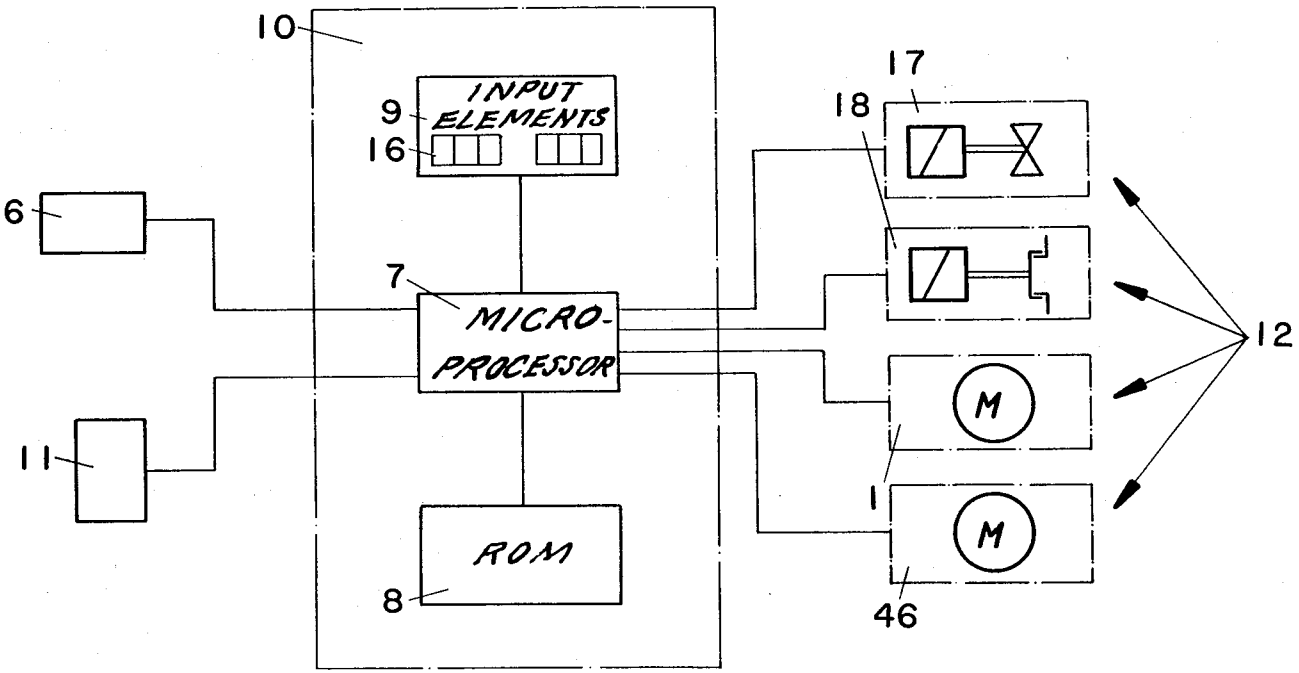
FIG. 5 is a block diagram of a control unit for an alternate preferred embodiment of the invention, particularly suitable for the production of pocket slashes with a flap, in which the sewing device has two drive motors.
Figure 9:
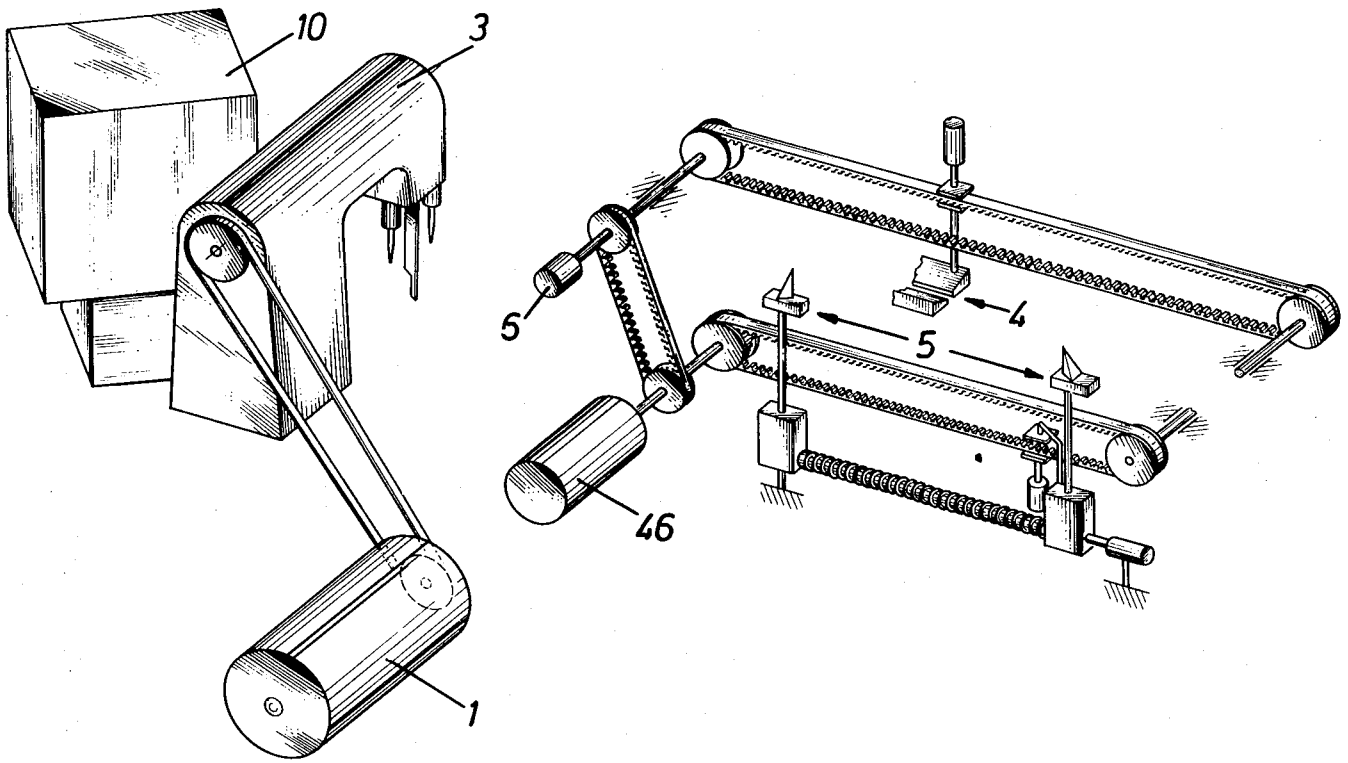
FIG. 9 is a partially exploded perspective view of an alternate preferred embodiment of a sewing device according to the invention.

In FIG. 1 it is seen that the sewing and cutting tools of the two-needle sewing machine 3, as well as the sewing-material transport device 4 and the angle cutting knife 15 of the cutting device 5, have completely synchronous programs of movement after the necessary coupling or clamping steps have occurred. As will be further discussed below, such synchronous operation may also be obtained in a device employing two separate drives, as shown in FIGS. 5 and 9, by regulating the relative speeds of the electric motors 1 and 46.

Figure 2:
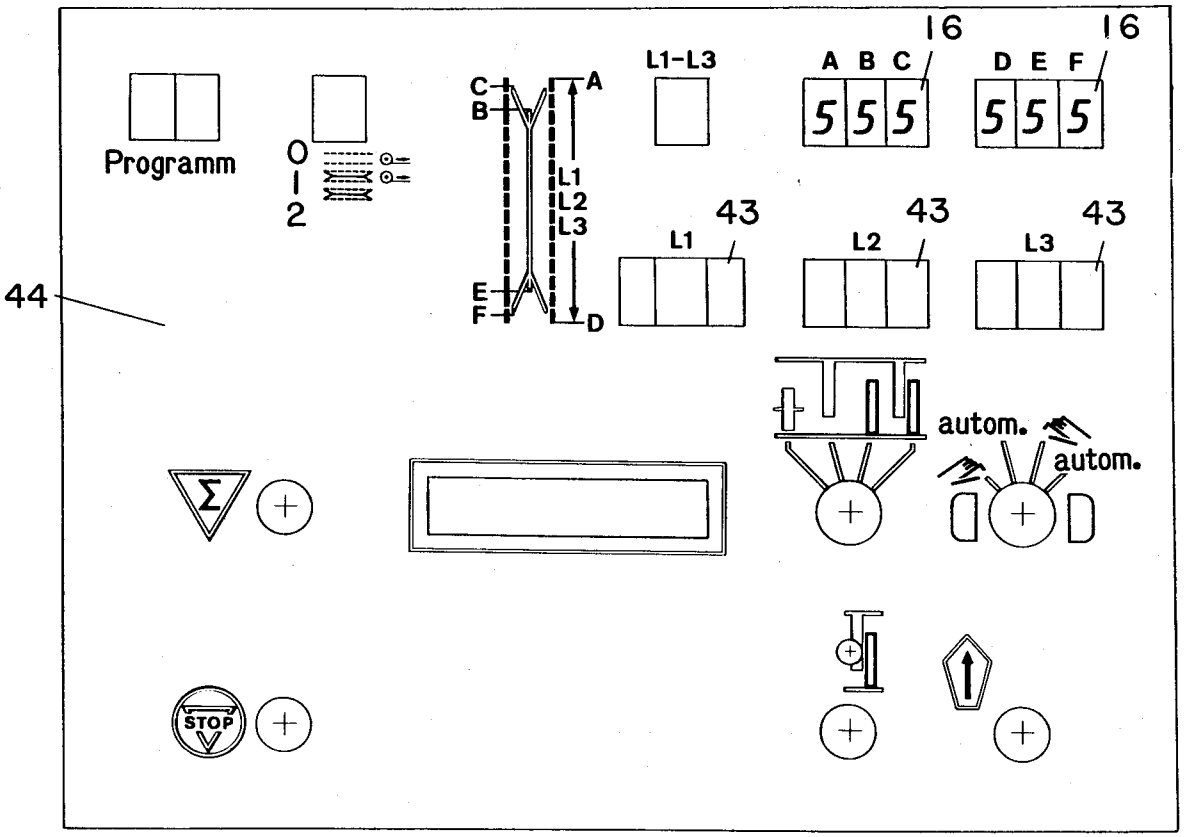
FIG. 2 is a front view of a control unit for the device of FIG. 1.

An important component of the sewing device is a control unit 10, which is fastened on the tabletop within easy reach of the operator and in his or her field of view. A front panel 44 of the control unit 10 is shown in FIG. 2. The panel comprises input elements 9 including several multi-digit preselector switches 43 for setting preselected seam lengths L1, L2 and L3. By means of further multi-digit preselector switches 16, numbers from 0 to 9 may be entered to set the points of attack of the sewing needles 13, the center knife 14 and the angle cutting knives 15, 36 at the start and end of a pocket slash; for example:

1. The preselector switch designated A controls the first penetration of the sewing needles 13 at the start of the seam.

2. The preselector switch designated D controls the last penetration of the sewing needles 13 at the end of the seam.

3. The preselector switch designated B controls the first cut of the center knife 14 in the vicinity of the start of the seam.

4. The preselector switch designated E controls the last cut of the center knife 14 in the vicinity of the end of the seam.

5. The preselector switch designated C controls the position of the gusset cut 31 produced by the angle cutting knife 36 in the vicinity of the start of the seam.

6. The preselector switch designated F controls the position of the gusset cut 31 produced by the angle cutting knife 15 in the vicinity of the end of the seam.

Figure 3:
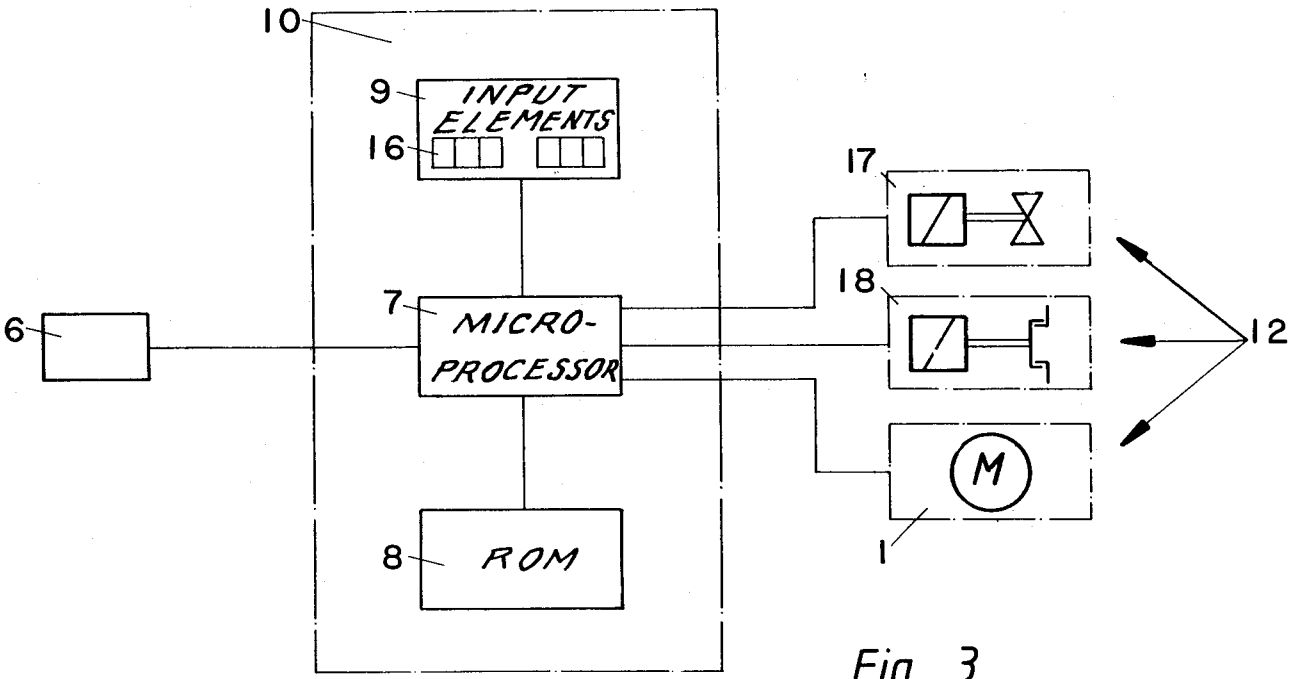
FIG. 3 is a block diagram of a control unit for a sewing device which is particularly suitable for the production of pocket slashes without a flap.

Referring to FIG. 3, control unit 10 includes a microprocessor and a read-only memory (ROM) 8, for example an EPROM or PROM. Machine-related geometrical data are placed in the form of binary coded numbers in the read-only memory 8. The machine-related geometrical data are understood to include:

1. Length measurements, with respect to the point of penetration of the sewing needles 13, which define the arrangement in space of the feed station located in front of the point of sewing, in the vicinity of which—customarily within 180 mm—the pocket slash to be sewn can be placed. In the case of pocket slashes without a flap, this region may be defined by two marker lights arranged in front of the place of sewing. In the case of pocket slashes with a flap, this region may be defined by mechanical stops, one of which serves as a stop point for the front edge of the flap and the other as a stop point for the rear edge of the flap.

2. Length measurements, with respect to the point of penetration of the sewing needles 13, defining the arrangement in space of the center knife 14.

3. Length measurements, with respect to the point of penetration of the sewing needles 13, defining the arrangement in space of the angle cutting knives 15 and 36.

Figure 4:
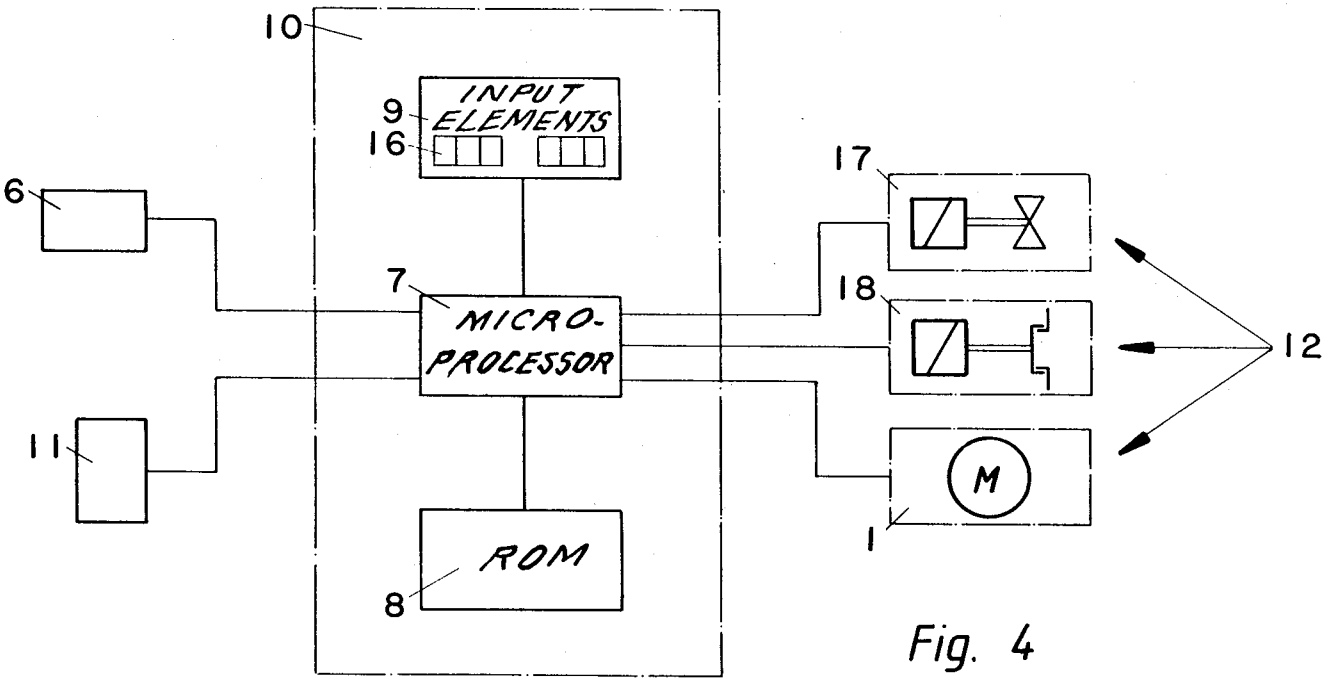
FIG. 4 is a block diagram of a control unit for a sewing device with one common drive motor which is particularly suitable for the production of pocket slashes with a flap.

Referring to FIG. 4, for sewing pocket slashes with a flap, a photoelectric cell 11 is provided a given distance in front of the sewing needles 13. The front and rear edges of the flap are scanned with the cell 11, and then the length of the pocket-slash seam to be sewn is derived precisely from the measured length of the flap. The scanning signals from the photoelectric cell 11 are fed, in accordance with FIG. 4, to the microprocessor 7.

As already mentioned, an incremental pulse generator 6 supplies the microprocessor 7 with pulses which correspnd to the displacement movements (travel paths) of the sewing-material transport device 4 and of the angle cutting knife 15. It performs this function both in sewing pocket slashes provided with a flap and pocket slashes without a flap. By means of the pulses from the pulse generator 6, the travel paths of the sewing-material transport device 4 and of the movable angle cutting knife 15 are precisely monitored. In such an arrangement, monitoring may be performed with high precision, in that the pulse generator 6 may supply, for instance, three pulses for a travel path of 1 mm.

Referring to FIGS. 3–4, the sewing device also includes a plurality of output elements 12, which include the electric motor 1, solenoid valves 17 and electromagnetic clutches 18. The closing and opening of the clamps 35 and 39 is effected by the solenoid valves 17. The electromagnetic clutches 18 actuate the clutch 22, which is provided on the drive shaft 21 and effects the turning on of the two-needle sewing machine. They furthermore actuate a clutching arrangement, preferably at least two clutches, provided in the step-down gearing 24 for selecting different speeds of advance.

FIGS. 5 and 9 illustrate an alternate preferred embodiment of the invention, including at least one additional electric motor 46, which may be a DC motor or a stepping motor. As can be noted from FIG. 9, the electric motor 46 drives the sewing-material transport device 4 and the cutting device 5. In this embodiment, the step-down gearing 24, the electromagnetic clutches contained therein, the V-belt 20, the countershaft 21 and the clutch 22 can be dispensed with. Thus a substantially simplified mechanism is achieved.

The manner of operation of the sewing device, which is suitable for producing pocket slashes, with or without a flap, will now be described with reference to FIGS. 6–8.

Figure 6:
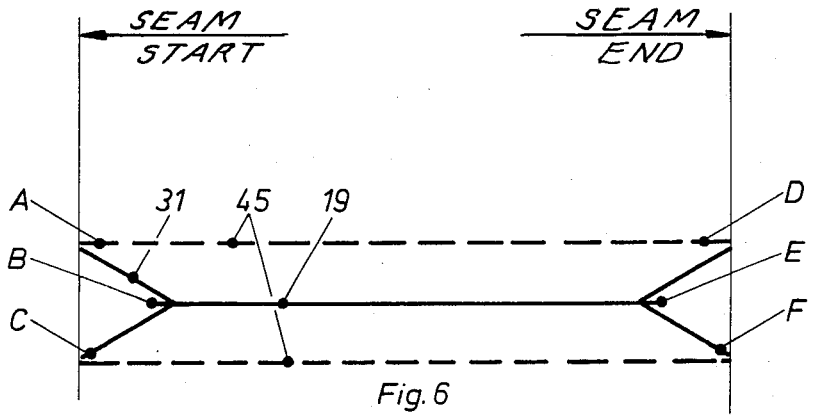
FIG. 6 is a diagrammatic view of a pocket slash.
Figure 7:
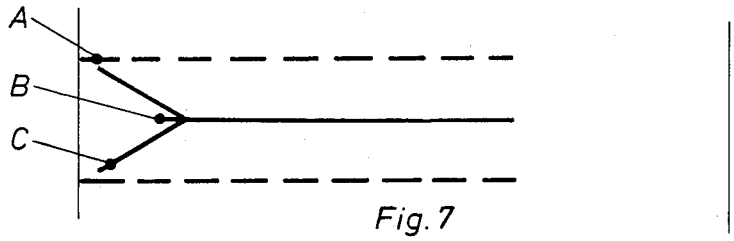
FIG. 7 is a diagrammatic view of part of a pocket slash in which the points of attack of the angle cutting knife and the center knife have been moved back relative to the start of the seam.

If all of the preselector switches 16 designated A–F in FIG. 2 have been set to the number 5, an opening is produced whose points A to F assume the positions shown in FIG. 6. A pocket slash developed in this manner corresponds to the basic position of the automatic pocket-slash sewing machine. However, deviations may readily be made from this normal form of the pocket slash, by means of the invention.

Thus, upon the sewing of pocket slashes without a flap, in loosely woven or loosely knitted sewing material, it is advisable to shift the gusset cut 31 produced by the angle cutting knives 15, 36 by a certain distance, i.e. the point C is shifted to behind the point A (See FIG. 7), and the point F is shifted to in front of the point D. (The term "front" is employed herein to mean the direction toward the start of the seam, i.e. leftward in FIGS. 6–8.) Starting from the normal case shown in FIG. 6, the points C and F are thus brought closer together. In this way, the corners of the pocket-slash opening are prevented from tearing and thus unraveling upon the turning of the completed pocket slash. Tearing, which occurs less readily in the case of firmly-woven sewing material, is typical in the case of loosely woven or knitted sewing material.

The moving back of the point C and the moving forward of the point F are achieved by a very simple operation in which the operator sets the number 6 on the preselector switch 16 designated C and the number 4 on the preselector switch designated F.

In principle, the rule applies that if the number set is greater than 5 the function in question will be started later. If the number set is less than 5 then the function in question will be started earlier. If the extent of the backward movement, for instance of the point C, is to be even greater, then a number larger than 6, up to a maximum of 9, is to be set. On the other hand, lower settings than 5 are used when the extent of the forward displacement, for instance of the point F, is to be made greater.

Corresponding to the displacement of the points C and F, the points B and E (see FIG. 6) for the insertion and withdrawal of the center knife 14 should also be shifted by corresponding adjustments of the preselector switches 16 marked B and E.

Figure 8:
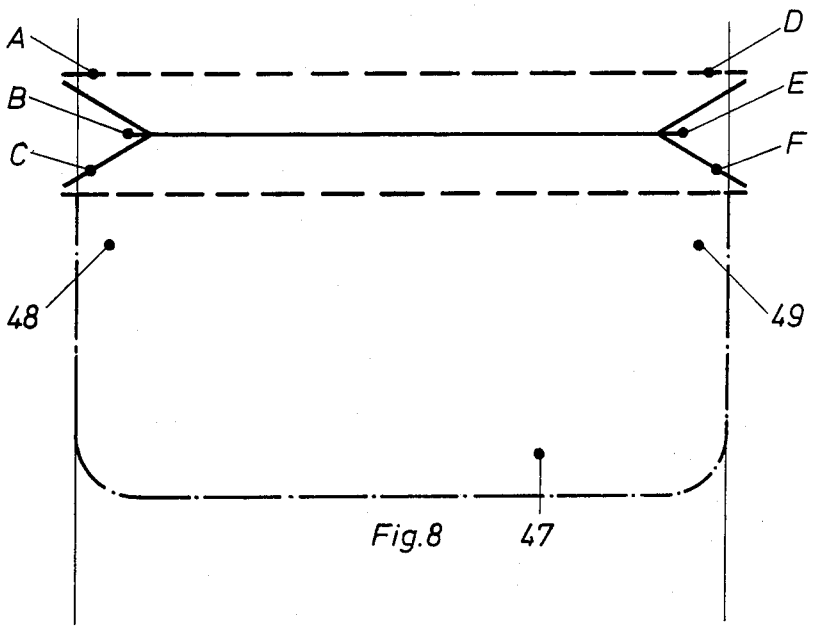
FIG. 8 is a diagrammatic view of a pocket slash with a flap, in which the points of attack of both sewing needles, of the center knife, and of the angle cutting knives have been shifted forward slightly.

Before the sewing of a pocket slash with a flap, it may be advisable, starting from the basic position, to move the point A slightly forward and the point D slightly backward, as seen in FIG. 8. In this way the distance between the points A and D is increased. This shifting of the two points should be effected if, in sewing a pocket slash with a flap, bulges appear in the flap 47 after turning. Such bulges may occur primarily in the region 48 of the front edge of the flap and in the region 49 of the rear edge of the flap. In order to avoid the bulges, the operator should set a value of 4 on the preselector switch 16 designated A and a value of 6 on the preselector switch designated D. The points C and F as well as B and E should also be shifted analogously corresponding to the displacement of the points A and D.

Thus, by these embodiments of the invention it is possible to move the points of commencement of the parallel seams, the center knife, and the angle cutting knives, individually or jointly, forward or backward from the basic operating position of the machine, by a simple adjustment of a readily accessible control unit.

Although illustrative embodiments of the invention have been described in detail herein, it is to be understood that the invention is not limited to such embodiments. Rather, variations and modifications of the embodiments may occur to those skilled in the art within the scope of the invention, as limited only by the claims.

What is claimed is:

1. A sewing device for producing piped openings in sewing material, comprising (a) motor means;

(b) a two-needle sewing machine driven by the motor means having a vertically moveable center knife between said two needles for cutting an opening to be piped; and having a main shaft for input of motive force from the motor means for driving and positioning said needles and said center knife;

(c) a cutting device driven by the motor means, including two vertically moveable angle cutting knives for forming gusset cuts;

(d) a material transport device for receiving material to be sewn and transporting such material between said sewing machine and said cutting device; said transport device being driven by said motor means; said main shaft of the sewing machine being synchronized with the cutting device and with the material transport device; and (e) control means for controlling said motor means, said sewing machine, said cutting device and said material transport device, for obtaining selected interrelated movements thereof for producing piped openings in such sewing material;

said control means comprising (i) at least one movement sensor for sensing movement of said cutting device and said transport device and generating movement signals that are representative of the displacement thereof; and (ii) a control unit including input means, output means, a microprocessor, and a ROM:

said ROM being for storing data that are representative of a plurality of predetermined movements that may be performed by said motor means, said sewing machine, said cutting device and said material transport device for producing piped openings having selected characteristics; said input means being for receiving input data indicative of selected ones of said predetermined movements to be performed;

said microprocessor being for receiving said movement signals, said stored data, and said input data, and in response thereto, generating output data for controlling movement of said motor means, said sewing machine, said cutting device and said material transport device to produce piped openings in such sewing material having such selected characteristics; and said output means being for receiving such output data from said microprocessor for controlling said movement of said motor means, said sewing machine, said cutting device and said material transport device to produce such openings, including relative times of beginning and ending operation of said needles and knife of said sewing machine, and of said cutting device and thereby the locations of operation thereof in the sewing material.

2. A sewing device as in claim 1, wherein said input means comprises a plurality of switches.

3. A sewing device as in claim 1, wherein said input data include data indicative of characteristics of seams to be sewn by said needles, cutting to be performed by said center knife, and gusset cuts to be made by said cutting device.

4. A sewing device as in claim 1, wherein said transport device and said cutting device are interconnected and synchronized by gearing means for being commonly driven.

5. A sewing device as in claim 4, wherein said movement sensor is coupled to said gearing means for sensing movement of said gearing means and thereby sensing movement of said cutting device and said transport device.

6. A sewing device as in claim 5, wherein said gearing means includes an intermediate shaft and said movement sensor is a rotation sensor coupled to said intermediate shaft for sensing rotation thereof.

7. A sewing device as in claim 6, wherein said rotation sensor generates electrical pulses in response to said rotation of said intermediate shaft.

8. A sewing device as in claim 5, wherein said motor means comprises one motor coupled to said cutting device, said transport device and said main shaft of said sewing machine for commonly driving and synchronizing the same.

9. A sewing device as in claim 8, wherein said gearing means includes respective driven belts for driving said cutting device and said transport device, and said output means comprises two clamps for selectively clamping each said device to its respective driven belt for movement therewith, said clamps being controlled by said control unit.

10. A sewing device as in claim 9, wherein each said clamp includes a respective solenoid valve for actuating said clamp.

11. A sewing device as in claim 8, wherein said motor is coupled to said gearing means by a drive train, said output means comprising an electromagnetic clutch in said drive train which is actuated by said control unit for selectively connecting said motor to said drive train.

12. A sewing device as in claim 11, wherein said drive train further has step-down gearing therein for transmitting the output of said motor to said gearing means, said output means comprising at least one electromagnetic clutch which is actuated by said control means for controlling said step-down gearing.

13. A sewing device as in claim 8, wherein said motor is a DC motor.

14. A sewing device as in claim 8, wherein said motor is a stepping motor.

15. A sewing device as in claim 5, wherein said motor means comprises a first motor drivingly coupled to said main shaft of said sewing machine, and a second motor drivingly coupled to said cutting device and said transport device, said first and second motors being synchronized by said output data from the microprocessor.

16. A sewing device as in claim 15, wherein said motor is a DC motor.

17. A sewing device as in claim 15, wherein said motor is a stepping motor.

* * * * *